US006959695B2

(12) United States Patent
Warner et al.

(10) Patent No.: US 6,959,695 B2
(45) Date of Patent: Nov. 1, 2005

(54) MULTI-POINT FUEL INJECTION MODULE

(75) Inventors: William M. Warner, Summerville, SC (US); Brian Joseph Vivio, Madison Heights, MI (US); Brian Joseph Bachand, Royal Oak, MI (US)

(73) Assignee: Robert Bosch Corporation, Broadview, IL (US)

( * ) Notice: Subject to any disclaimer, the term of this patent is extended or adjusted under 35 U.S.C. 154(b) by 73 days.

(21) Appl. No.: 09/981,223

(22) Filed: Oct. 17, 2001

(65) Prior Publication Data

US 2003/0070658 A1 Apr. 17, 2003

(51) Int. Cl.[7] ..... F02M 37/04
(52) U.S. Cl. ..... 123/468; 123/456
(58) Field of Search ..... 123/470, 468, 123/469, 456, 447, 472; 239/600, 585.1–585.5

(56) References Cited

U.S. PATENT DOCUMENTS

| | | | | |
|---|---|---|---|---|
| 4,092,517 A | * | 5/1978 | Woodacre | 219/137 PS |
| 4,295,452 A | | 10/1981 | Lembke et al. | |
| 4,541,649 A | * | 9/1985 | Grunfeld | 280/281.1 |
| 4,552,311 A | | 11/1985 | Casey | |
| 4,660,531 A | * | 4/1987 | Lauterbach et al. | 123/456 |
| 4,966,120 A | | 10/1990 | Itoh et al. | |
| 4,982,716 A | | 1/1991 | Takeda et al. | |
| 5,086,743 A | | 2/1992 | Hickey | |
| 5,120,084 A | | 6/1992 | Hashimoto | |
| 5,127,382 A | | 7/1992 | Imoehl | |
| 5,168,857 A | * | 12/1992 | Hickey | 123/468 |
| 5,172,671 A | | 12/1992 | Peters et al. | |
| 5,172,939 A | | 12/1992 | Hashimoto | |
| 5,189,782 A | | 3/1993 | Hickey | |
| 5,197,435 A | | 3/1993 | Mazur et al. | |
| 5,215,063 A | | 6/1993 | Yeh | |
| 5,220,900 A | | 6/1993 | Wakeman | |
| 5,295,468 A | | 3/1994 | Blessing et al. | |
| 5,363,825 A | | 11/1994 | Becker | |
| 5,390,638 A | | 2/1995 | Hornby et al. | |
| 5,398,656 A | | 3/1995 | Brisbane et al. | |
| 5,531,202 A | | 7/1996 | Lorraine | |
| 5,568,798 A | | 10/1996 | Lorraine | |
| 5,577,480 A | | 11/1996 | Gmelin et al. | |
| 5,597,980 A | | 1/1997 | Weber | |
| 5,598,824 A | | 2/1997 | Treusch et al. | |
| 5,603,302 A | * | 2/1997 | Minagawa et al. | 123/456 |
| 5,611,313 A | | 3/1997 | Ashcraft | |
| 5,616,037 A | | 4/1997 | Lorraine et al. | |
| 5,617,827 A | * | 4/1997 | Eshleman et al. | 123/456 |
| 5,657,733 A | | 8/1997 | Dozier et al. | |
| 5,713,323 A | | 2/1998 | Walsh et al. | |
| 5,718,206 A | * | 2/1998 | Sawada et al. | 123/470 |
| 5,735,247 A | | 4/1998 | Tsuzuki et al. | |
| 5,743,235 A | | 4/1998 | Lueder | |
| 5,771,863 A | | 6/1998 | Daly | |
| 5,775,302 A | * | 7/1998 | Guido et al. | 123/468 |
| 5,934,252 A | | 8/1999 | Hafner et al. | |
| 5,934,253 A | | 8/1999 | Kojima et al. | |
| 6,053,149 A | | 4/2000 | Lorraine | |
| 6,196,195 B1 | | 3/2001 | Trutschel et al. | |
| 6,205,979 B1 | * | 3/2001 | Sims, Jr. et al. | 123/467 |
| 6,227,170 B1 | * | 5/2001 | Koshiba | 123/456 |
| 6,341,595 B1 | * | 1/2002 | Scollard et al. | 123/456 |
| 6,622,700 B2 | | 9/2003 | Lee et al. | |
| 2002/0038649 A1 | | 4/2002 | Scollard et al. | |

FOREIGN PATENT DOCUMENTS

| | | |
|---|---|---|
| AT | 004632 U1 | 9/2001 |
| DE | 19757347 | 6/1998 |
| DE | 19744094 | 5/1999 |
| DE | 19937444 | 1/2001 |
| EP | 1063420 | 12/2000 |
| EP | 1201916 | 5/2002 |
| GB | 818197 | 8/1959 |
| JP | 10141171 | 5/1998 |

* cited by examiner

*Primary Examiner*—Carl S. Miller
(74) *Attorney, Agent, or Firm*—Michael Best & Friedrich LLP

(57) ABSTRACT

An injection module assembly includes a fuel rail defining a passageway through which a fuel can flow, and a plurality of fuel injectors for delivering the fuel in the passageway to a respective plurality of combustion chambers in an internal combustion engine. The fuel injectors are coupled to the fuel rail such that an interface between the fuel rail and each fuel injector is substantially sealed to substantially prevent leakage of both liquid fuel and hydrocarbon emissions from the interface. The injection module assembly further includes an electrical connector coupled to the fuel rail and to each of the injectors for providing electrical power to each injector, and an overmolding covering at least a portion of the fuel rail, at least a portion of the electrical connector, and at least a portion of each fuel injector.

38 Claims, 7 Drawing Sheets

MULTI-POINT FUEL INJECTION MODULE

FIELD OF THE INVENTION

The invention relates to fuel injection modules for the fuel system of an internal combustion engine.

BACKGROUND OF THE INVENTION

A fuel rail supplies fuel to a plurality of fuel injectors that inject the fuel into the intake manifold of the engine. Typically, electromagnetic fuel injectors are removably secured to the fuel rail using clips, or other similar mechanical attachment means. Each injector includes a seal ring adjacent the inlet end of the injector. The seal ring functions to seal the interface between the injector and the fuel rail so that no fuel leaks from the fuel rail at the fuel rail/injector interface.

FIG. 1 illustrates a portion of a prior art fuel rail assembly 10. The assembly 10 includes a metallic fuel rail 14 and a plurality of fuel injectors 18 coupled to the fuel rail 14 via standard connector clips 22. The clips 22 couple the injectors 18 to respective adapter cups 26 that are secured to the fuel rail 14. Each injector 18 includes a seal ring 30 (only one is shown) that seals the fuel pathway between the fuel rail 14 and the injector 18 so that the liquid fuel does not leak from the fuel rail 14.

Each injector 18 further includes an electrical socket 34 configured to receive a separate electrical connector (not shown) that provides electrical power to the injector 18 in a known manner. The socket 34 is typically formed by the plastic overmolding 38 that surrounds and protects most of the injector 18.

SUMMARY OF THE INVENTION

While the seal rings in prior art fuel rail assemblies substantially prevent any leakage of liquid fuel, evaporative hydrocarbons are still emitted around or directly through the resilient seal rings. With the recent push toward reducing and eventually eliminating the emission of evaporative hydrocarbons from automobiles, the need exists for a fuel rail assembly that is substantially sealed to prevent the emission of evaporative hydrocarbons.

The fuel injection module of the present invention operates with substantially zero evaporative emissions and is well-suited for existing fuel rail applications or for future fuel rail applications in vehicles that are restricted from emitting hydrocarbons. The present invention provides an improved injection module assembly having fuel injectors that are secured to the fuel rail by welding, brazing, or other suitable methods. Welding or brazing the injectors to the fuel rail eliminates the need for the seal rings at the fuel rail/injector interfaces because the welding or brazing operations substantially seal the interfaces, thereby preventing fuel leakage. The welded or brazed interface also substantially eliminates the emission of evaporative hydrocarbons that can otherwise occur around or directly through the resilient seal rings.

In addition to eliminating the seal rings, the invention has injectors that are mounted to the fuel rail without the use of clips or other removable fastening means. Extension tubes or bellows can be inserted between the injectors and the fuel rail as needed, depending on the desired configuration. The same welding or brazing techniques can be used with the extension tubes and bellows to seal the interface between the fuel rail and the injectors.

The injection module assembly of the invention also includes an electrical connector in the form of a bus-bar coupled to the fuel rail and to the injectors to provide electrical power to the injectors. The bus-bar is configured to provide a single multi-pin connector that can be connected to a single input plug. Input from the single plug provides electrical power to all of the injectors. In a preferred embodiment, the bus-bar is at least partially overmolded with plastic to electrically isolate the bus-bar from the fuel rail. Portions of the overmolding function as clips that couple the bus-bar to the fuel rail.

Once the injectors are welded or brazed to the fuel rail, and electrical contacts are created between the injectors and the bus-bar, the injection module assembly is overmolded with plastic to substantially encase and protect the fuel rail, the bus-bar, and at least a portion of each injector. The need for individually overmolding each injector separately is thereby eliminated. The injection module assembly of the present invention is compact, robust, substantially leak-proof, substantially emission-free, easy to transport, and easy to install.

More specifically, the invention provides an injection module assembly including a fuel rail defining a passageway through which a fuel can flow, and a fuel injector for delivering the fuel in the passageway to a combustion chamber of an internal combustion engine. The fuel injector defines a longitudinal axis and has an outlet end and an inlet end in opposing relation along the longitudinal axis. The injector is coupled to the fuel rail at the inlet end such that an interface between the fuel rail and the inlet end is substantially sealed to substantially prevent leakage of both liquid fuel and hydrocarbon emissions from the interface.

In one aspect of the invention, the fuel injector is coupled to the fuel rail by one of laser welding, TIG welding, and brazing. In another aspect, the fuel injector is coupled to the fuel rail without using a seal ring adjacent the interface. In yet another aspect of the invention, the fuel injector can be directly connected to the fuel rail, can be coupled to the fuel rail via an extension tube, or can be coupled to the fuel rail via a bellows.

The invention also provides an injection module assembly including a fuel rail defining a passageway through which a fuel can flow, and a plurality of fuel injectors for delivering the fuel in the passageway to a respective plurality of combustion chambers in an internal combustion engine. The fuel injectors are coupled to the fuel rail such that an interface between the fuel rail and each fuel injector is substantially sealed to substantially prevent leakage of both liquid fuel and hydrocarbon emissions from the interface. The injection module assembly further includes an electrical connector coupled to the fuel rail and to each of the injectors for providing electrical power to each injector, and an overmolding covering at least a portion of the fuel rail, at least a portion of the electrical connector, and at least a portion of each fuel injector.

The invention further provides a method of manufacturing an injection module assembly having a fuel rail, a plurality of fuel injectors, and an electrical connector. The method includes coupling the fuel injectors to the fuel rail such that respective interfaces between the fuel rail and the fuel injectors are substantially sealed to substantially prevent leakage of both liquid fuel and hydrocarbon emissions from the interfaces, coupling the electrical connector to the fuel rail and to each of the injectors to provide electrical power to the injectors, and overmolding at least a portion of the fuel rail, at least a portion of the electrical connector, and at least a portion of each injector to form an injection module assembly.

Other features and advantages of the invention will become apparent to those skilled in the art upon review of the following detailed description, claims, and drawings.

Figure 1:
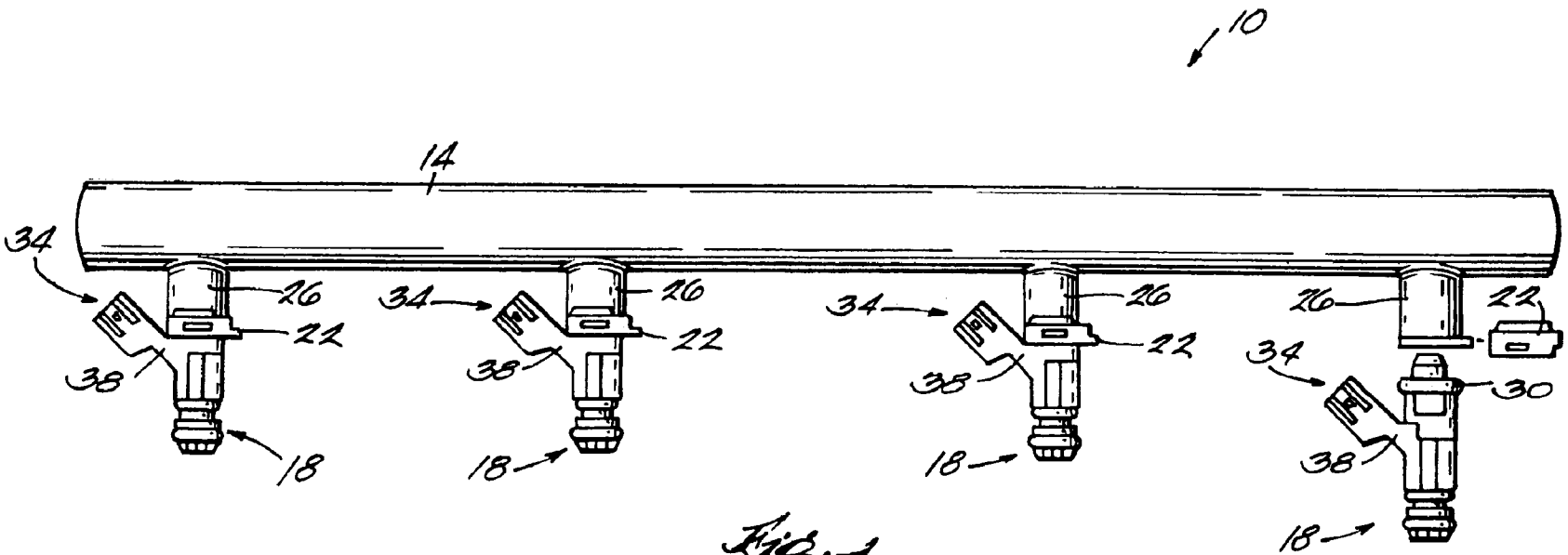
FIG. 1 PRIOR ART
FIG. 1 is a prior art fuel rail assembly shown with one of the fuel injectors exploded.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 2:
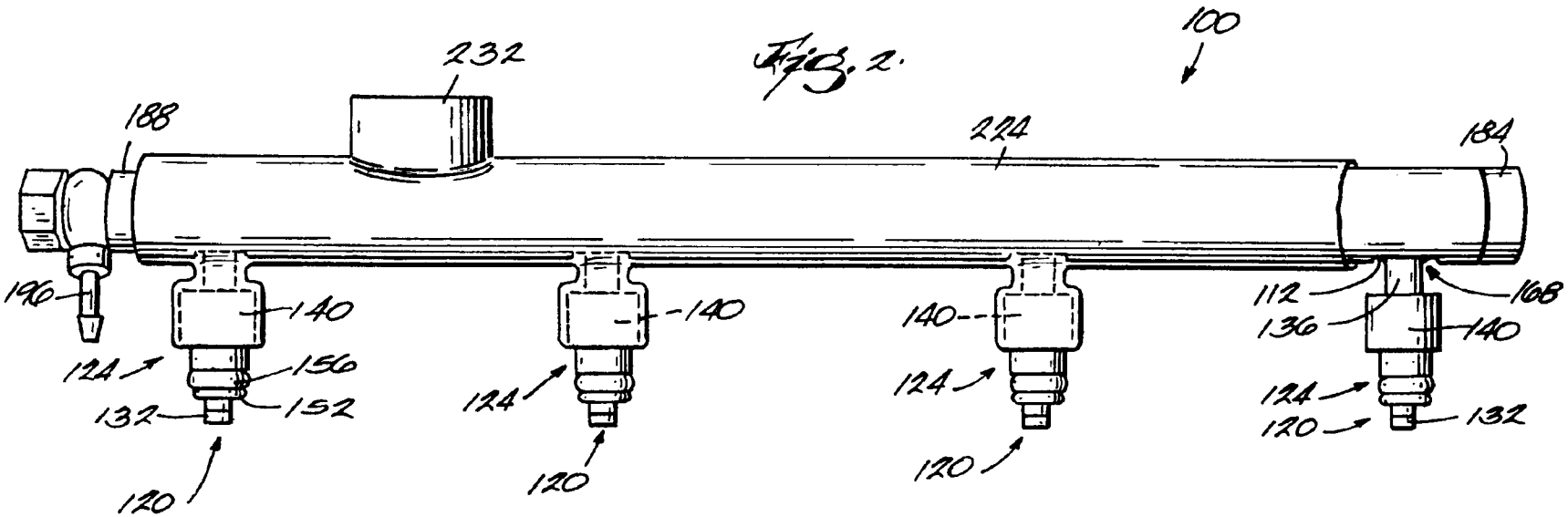
FIG. 2 is a perspective view of an injection module assembly embodying the invention shown with a portion of the overmolding broken away to reveal the interface between the injector and the fuel rail.
Figure 2A:
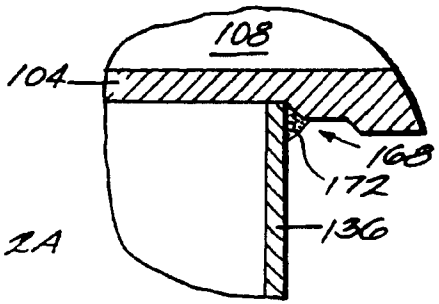
FIG. 2A is an enlarged portion of FIG. 2, more clearly showing the injector/fuel rail interface.
Figure 3:
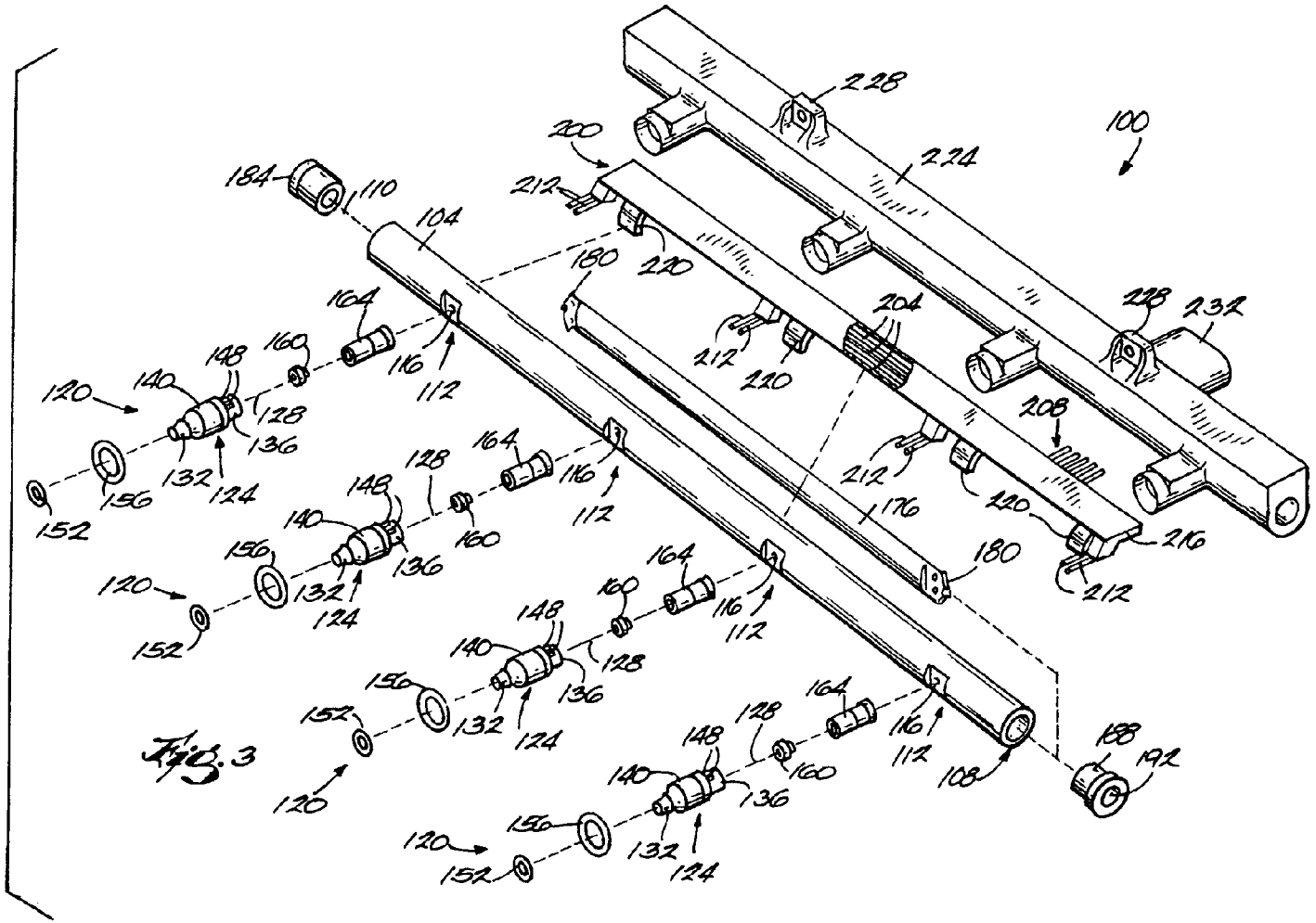
FIG. 3 is an exploded view of the injection module assembly of FIG. 2, shown incorporating extension tubes.

FIGS. 2, 2A, and 3 illustrate an injection module assembly 100 embodying the invention. As illustrated, the injection module assembly 100 is an in-line injection module assembly designed for use with a four-cylinder internal combustion engine, however, it is to be understood that other configurations of injection module assemblies are also contemplated by the invention.

Referring to FIG. 3, the injection module assembly 100 includes a fuel rail 104 defining a passageway 108 for carrying fuel (not shown). The fuel rail 104 defines a longitudinal axis 110. In the illustrated embodiment, the fuel rail 104 is made from metal, such as stainless steel, and has a substantially circular cross-section. Of course, the fuel rail 104 could be made from other materials and could also have other cross-sectional configurations, such as a substantially rectangular cross-section. The fuel rail 104 includes injector mounting regions 112 having fuel outlet apertures 116 communicating with the passageway 108. In the illustrated embodiment, the injector mounting regions 112 define a substantially flat surface in the otherwise arcuate outer surface of the fuel rail 104.

A plurality of fuel injector assemblies 120 are coupled to the fuel rail 104 so that each injector assembly 120 is located at, and coupled to, a respective injector mounting region 112, as will be described in greater detail below. The injector assemblies 120 are substantially identical to one another, and only one injector assembly 120 will be described in detail. The injector assembly 120 includes an electrically actuated fuel injector or injector valve 124 that injects fuel into an intake manifold or a combustion chamber of the engine (not shown). The illustrated fuel injector 124 is designated as the EV-14 injector functional group available from Robert Bosch Corporation, however, other makes of injector valves can also be used.

The fuel injector 124 defines a longitudinal axis 128 and includes an outlet end 132 and an inlet end 136 in opposing relation along the longitudinal axis 128. The fuel injector 124 also includes a body portion 140 that houses an electromagnetic coil assembly (not shown). The coil assembly is selectively charged to open the injector valve 124, permitting fuel to be discharged at the outlet end 132, as is understood by those skilled in the art. Terminals 148 are electrically connected to the coil assembly and extend from the body portion 140. The terminals 148 are electrically connected to a power supply (not shown) in the manner described below.

The illustrated injector assembly 120 also includes a mounting disc 152 and a seal ring 156 coupled to the outlet end 132. The mounting disc 152 and seal ring 156 facilitate connecting the outlet end 132 to the intake manifold. A filter 160 is inserted in the inlet end 136 of the injector 124 to filter fuel passing through the injector. Also shown in FIG. 3 as part of the injector assembly 120 is an extension tube 164. Using an extension tube 164 is one common way to increase the overall length of the injector assembly 120. It is important to note, however, that the injector assembly 120 need not include the extension tube 164. For example, FIGS. 2 and 2A illustrate the injector assembly 120 without the extension tube 164. Additionally, other structure, such as metallic bellows or adapters (discussed in more detail below) can also be used.

The injector assemblies 120 are coupled to the fuel rail 104 at the respective injector mounting regions 112. As best seen in FIGS. 2 and 2A, the inlet end 136 of each injector 124 is coupled to a respective injector mounting region 112 to define an interface 168 between the injector assembly 120 and the fuel rail 104. The injector 124 is coupled to the fuel rail 104 such that the longitudinal axis 128 of the injector 124 is substantially perpendicular to the longitudinal axis 110 of the fuel rail 104. The fuel injector 124 is coupled to the fuel rail 104 by a weld or braze bead 172 formed by laser welding, TIG welding, brazing, or other suitable direct connecting methods.

By welding or brazing the injector 124 directly to the fuel rail 104 it is possible to eliminate the seal ring typically required at the inlet end of a fuel injector. The fastening clip typically used with prior art fuel rail assemblies is also eliminated. In addition to reducing the number of parts, the direct and substantially permanent connection at the interface 168 substantially prevents the leakage of hydrocarbon emissions, in addition to substantially preventing the leakage of liquid fuel.

While FIGS. 2 and 2A illustrate the direct connection between the inlet end 136 of the injector 124 and the fuel rail 104, it is understood that a similar direct connection can be made between the end of the extension tube 164 and the fuel rail 104, as is the case for the embodiment shown in FIG. 3. To achieve the substantially leak-proof connection with an extension tube 164, the end of the extension tube 164 adjacent the inlet end 136 of the injector 124 is pressed into the inlet end 136 and then welded or brazed to the inlet end 136. Next, the opposite end of the extension tube 164 is directly welded or brazed to the fuel rail 104 in the same manner illustrated in FIG. 2A. In this manner, the overall length of the injector assembly 120 can be varied to suit the specific engine application, while maintaining the substantially leak-proof characteristic of the injection module assembly 100.

Returning to FIG. 3, the illustrated injection module assembly 100 also includes a damper 176 positioned in the fuel passageway 108 of the fuel rail 104 to dampen the pressure pulsations created by the injectors 124 during operation. The damper 176 is positioned in the passageway 108 using spring locators 180, such as those described in U.S. Pat. No. 6,205,979. Of course, other methods of positioning the damper 176 inside the passageway 108 can also be used.

An end plug 184 is then inserted into one open end of the fuel rail 104 to substantially close the one end of the fuel rail 104. A second end plug 188 is inserted into the opposite end of the fuel rail 104. The end plugs 184 and 188 can be laser-welded, TIG welded, or brazed to the fuel rail 104 to substantially seal the ends of the passageway 108. The end plug 188 has a fuel inlet aperture 192 for providing an inlet to the fuel passageway 108. As seen in FIG. 2, a fuel inlet nozzle 196 is coupled to the plug 188 for providing fuel to the fuel rail 104. Other configurations of fuel inlet devices can be substituted for the fuel inlet nozzle 196 shown in FIG. 2.

The injection module assembly 100 further includes an electrical connector assembly or bus-bar 200 that is coupled to the fuel rail 104 and to each of the injectors 124 to provide electrical power to the injectors 124. As illustrated in FIG. 3, the bus-bar 200 includes a plurality of elongated electrical leads 204. Each lead 204 terminates on one end at a multi-pin connector 208. The other end of each lead defines a contact 212 that extends from the bus-bar 200 to be aligned with a respective injector assembly 120. Each contact 212 is electrically connected, via welding, brazing, soldering or other suitable methods, to a respective injector terminal 148 to provide electrical signals to the respective coil assemblies.

As illustrated in FIG. 3, the electrical leads 204 of the bus-bar 200 are overmolded with a plastic overmolding 216 to protect the leads 204 and to electrically isolate the leads 204 from the fuel rail 104. Only the connector 208 and the contacts 212 extend from the overmolding 216. As will be described later with respect to FIG. 4, however, it is not necessary to overmold the leads 204 in the manner illustrated in FIG. 3. The overmolding 216 also defines clips 220 used to secure the bus-bar 200 to the fuel rail 104. The number and configuration of the clips 220 can vary. Alternatively, other methods of securing the bus-bar 200 to the fuel rail 104 can be substituted.

Once the bus-bar 200 is coupled to the fuel rail 104 and the electrical connections between the contacts 212 and the terminals 148 are made, the bus-bar 200, the fuel rail 104, and at least a portion of the injector assemblies 120 are overmolded with a protective plastic overmolding 224. The end plug 184 is also overmolded with the overmolding 224. At least a portion of the end plug 188 is not overmolded to permit access to the fuel inlet aperture 192.

As shown in FIG. 2, the overmolding 224 substantially encases the injector/fuel rail interfaces 168 as well as the body portions 140 and terminals 148 of each injector 124. By overmolding at least portions of each component of the injection module assembly 100, the injection module assembly 100 becomes a modular assembly that is compact, robust, substantially leak-proof, substantially emission-free, easy to transport, and easy to install.

The overmolding 224 also defines mounting flanges 228 (see FIG. 3) for mounting the injection module assembly 100 in the engine compartment of a vehicle. Of course, the configuration and location of the mounting flanges 228 can vary from application to application. Additionally, the overmolding 224 defines a socket 232 surrounding the multi-pin connector 208 of the bus-bar 200. The socket 232 is configured to receive a single plug (not shown) that supplies the electrical signals for each injector 124.

Figure 4:
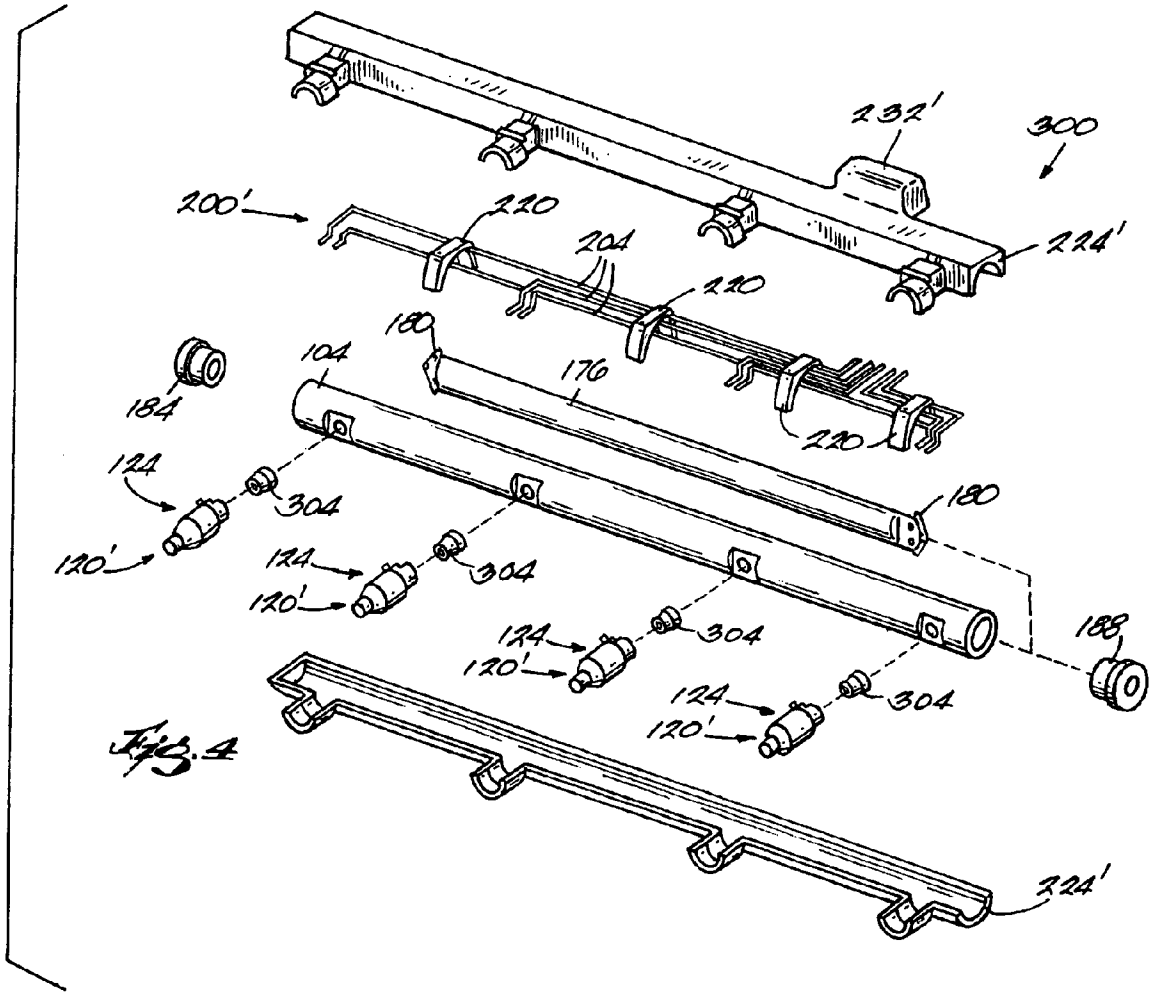
FIG. 4 is an exploded view of another injection module assembly embodying the invention.

FIG. 4 illustrates another embodiment of an injection module assembly 300. The injection module assembly 300 is similar to the injection module assembly 100, and like parts have been given like reference numerals. Modified parts have been given reference numerals designated as prime (′). The injection module assembly 300 has fuel injector assemblies 120′ including respective adapters 304 to replace the extension tubes 164. The adapters 304 facilitate welding or brazing the injectors 124 to the fuel rail 104 and can be coupled between the fuel rail 104 and the injectors 124 in the same manner described above for the extension tubes 164. The discs 152, seal rings 156, and filters 160 are not shown.

The bus-bar 200′ of the injection module assembly 300 includes the overmolded clips 220, but the remainder of the overmolding 216 is absent. Again, the clips 220 function to couple the bus-bar 200′ to the fuel rail 104, and also function to fix the leads 204 in the necessary configuration/orientation.

The protective overmolding 224′ (shown as two separate pieces in FIG. 4) is also somewhat modified in the injection module assembly 300. Specifically, the mounting flanges 228 are absent and the socket 232′ has a slightly different configuration.

Figure 5:
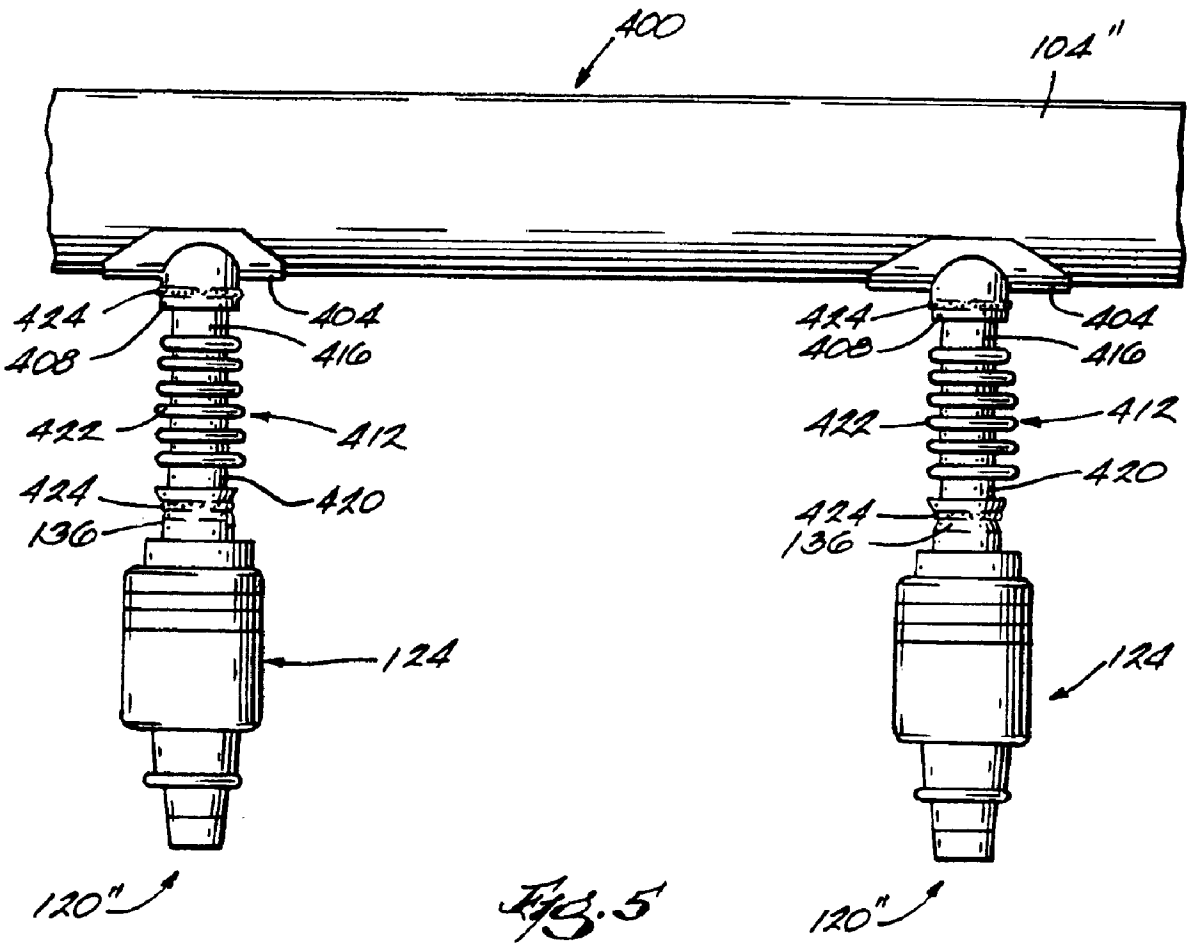
FIG. 5 is an enlarged view showing a portion of another injection module assembly embodying the invention.

FIG. 5 illustrates a portion of another embodiment of an injection module assembly 400 prior to mounting the bus-bar 200 and prior to applying the overmolding 224. Like parts have been given like reference numerals and modified parts have been given reference numerals designated as double prime (″). The injection module assembly 400 has a slightly modified fuel rail 104″ that includes injector mounting adapters 404 instead of the injector mounting regions 112. The adapters 404 are secured to the fuel rail 104″ by welding or brazing and include receiving ends 408 for receiving the injector assemblies 120″.

The injector assemblies 120″ include corrugated extension tubes or bellows 412 that are more resilient and flexible than the solid extension tubes 164. The bellows 412 help to eliminate tolerance stack-up problems that may occur when using the solid extension tubes 164. The bellows 412 are substantially identical and each bellows 412 includes an inlet end 416, an outlet end 420, and a corrugated body portion 422 extending between the inlet end 416 and the outlet end 420. While six corrugations are shown on the bellows 412, the number of corrugations can vary as desired. The inlet end 416 is preferably laser-welded to the respective receiving end 408 and the outlet end 420 is preferably laser-welded to the inlet end 136 of the respective injector 124 to achieve the leak-proof sealing discussed above. The laser-weld beads 424 are shown in FIG. 5. Of course, TIG welding, brazing, or other similar securing methods can also be used.

By incorporating the bellows 412, the injectors 124 can be more accurately positioned along the fuel rail 104″ for proper alignment with the receiving apertures in the intake manifold. In the illustrated embodiment, for example, the longitudinal axis of the bellows 412 can be varied through a range of approximately six degrees as it extends from the inlet end 416 to the outlet end 420. The bellows 412 are preferably made from stainless steel, however, other fuel-resistant materials can also be used.

Figure 6:
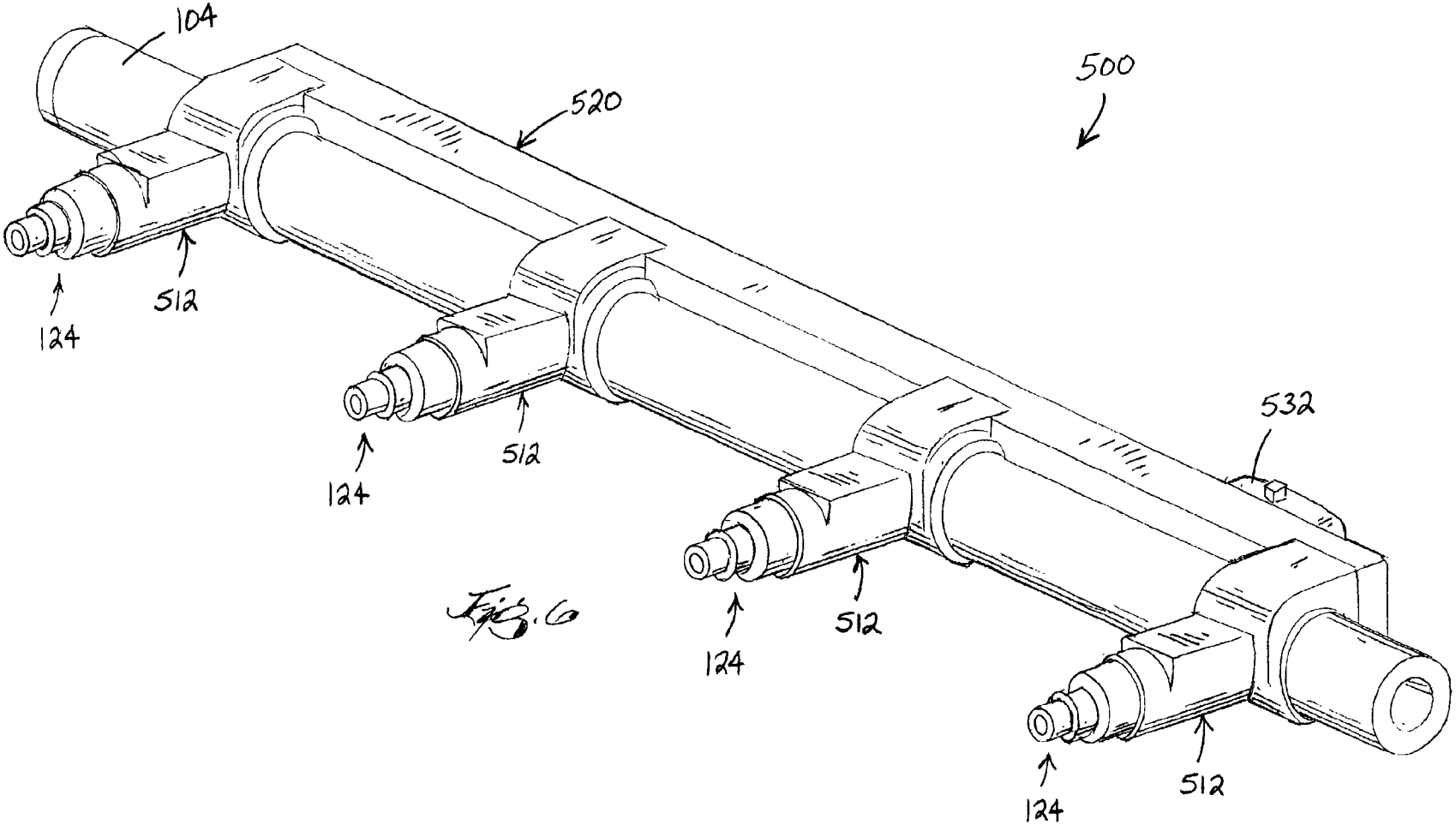
FIG. 6 is a perspective view of yet another injection module assembly embodying the invention.
Figure 7:
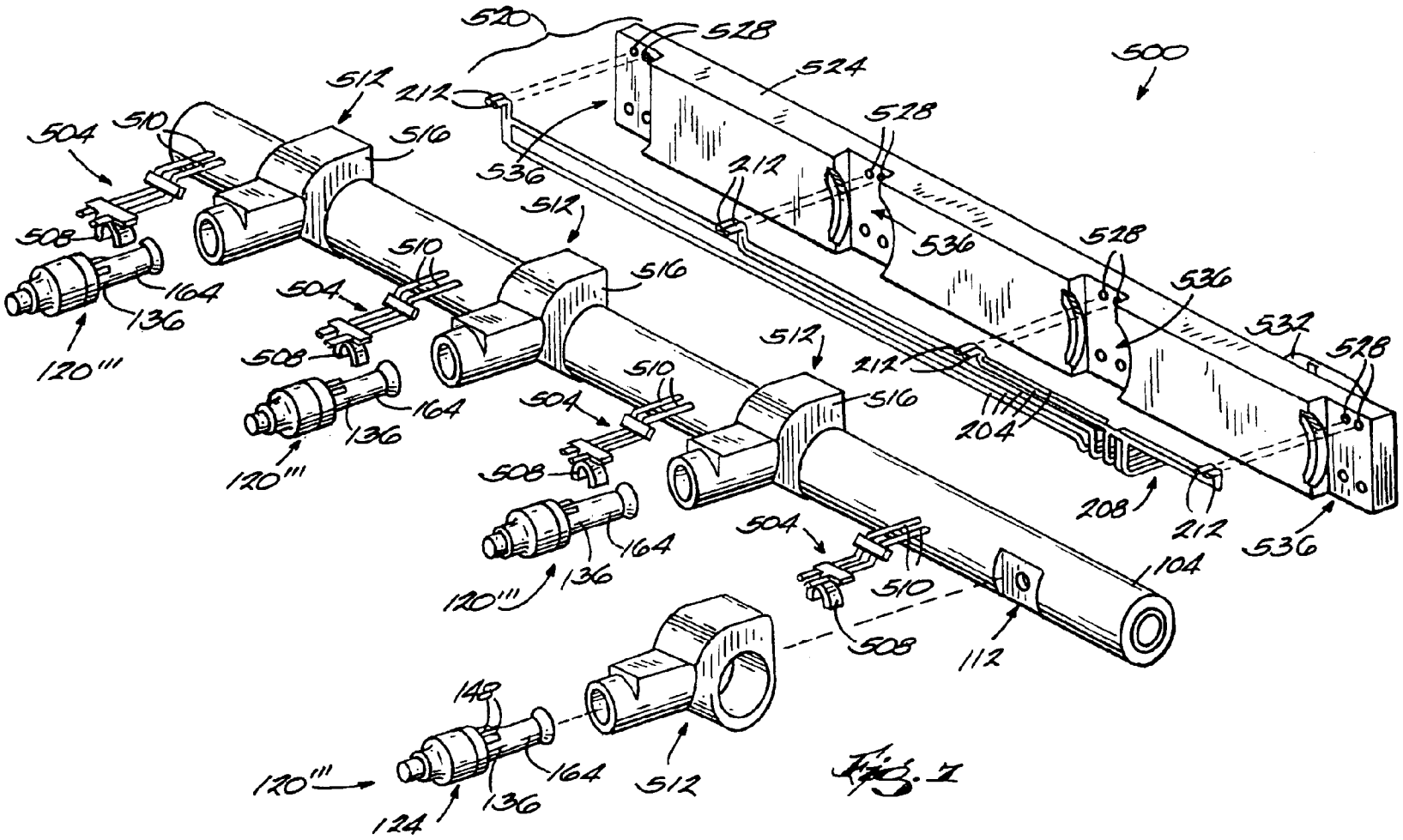
FIG. 7 is an exploded view of the injection module assembly of FIG. 6.

FIGS. 6 and 7 illustrate another embodiment of an injection module assembly 500. Like parts have been given like reference numerals and modified parts have been given reference numerals designated as triple prime (‴). With one main exception, the fuel injector assemblies 120‴ are substantially identical to the fuel injector assemblies 120 and are coupled to the fuel rail 104 in the same manner described above. Each fuel injector assembly 120‴ further includes a terminal extension assembly 504 that is coupled to the inlet end 136 of the fuel injector 124 or the extension tube 164 via a clip 508. The terminal extension assembly 504 includes terminal extensions 510 that are electrically connected to the terminals 148 via welding, soldering, or brazing. The purpose of the terminal extension assemblies 504 will be discussed in greater detail below.

The injection module assembly 500 also includes individual plastic overmoldings 512 instead of the unitary overmolding 224 used with the injection module assembly 100. Each plastic overmolding 512 encases at least a portion of a respective injector 124, a respective extension tube 164, and at least a portion of a respective terminal extension assembly 504. As best shown in FIG. 7, each overmolding 512 also encases a portion of the fuel rail 104, including the respective injector mounting region 112.

As illustrated in FIGS. 6 and 7, each overmolding 512 includes a substantially flat mounting surface 516 configured to receive an overmolded bus-bar assembly 520. Referring to FIG. 7, the bus-bar assembly 520 includes the leads 204, with each lead 204 terminating in the multi-pin connector 208 at one end and at the contact 212 at the other end. The leads 204 are overmolded with an overmolding 524 such that the contacts 212 extend from the overmolding 524 at outlets 528. The multi-pin connector 208 extends from the overmolding 524 and is surrounded by a socket 532 defined by the overmolding 524.

The overmolding 524 includes a plurality of mounting recesses 536 configured to engage the respective mounting surfaces 516 of the overmoldings 512. The contact outlets 528 are positioned within the mounting recesses 536 such that when the bus-bar assembly 520 is mounted to the mounting surfaces 516, electrical contact is made between the contacts 212 and the respective terminal extensions 510. The bus-bar assembly 520 can be mounted to the overmoldings 512 using fasteners, adhesives, or other suitable connecting devices. It should be noted that the configurations of the overmoldings 512 and the overmolding 524 can vary from the illustrated embodiment, to accommodate the components used and the space available in the engine compartment. Furthermore, the configuration of the engagement surfaces between the overmoldings 512 and the overmolding 524 can also be varied. While no damper is shown in FIG. 7, the damper 176 could be included if desired.

Various modifications and alterations to the injection module assemblies 100, 300, 400, and 500 can be made without departing from the scope of the invention. For example, any of the injection module assemblies 100, 300, 400, and 500 can be assembled with the extension tubes 164, the adapters 304, or the bellows 412. Likewise, with each injection module assembly 100, 300, 400, and 500, the injectors 124 can be directly connected to the fuel rails 104, 104" without using the extension tubes 164, the adapters 304, or the bellows 412.

Other components of the various injection module assemblies 100, 300, 400, and 500 can also be interchanged as desired. For example, the bus-bars 200 and 200' can be substituted for one another. Additionally, the terminal extension assemblies 504 can be utilized with the injection module assemblies 100, 300, and 400, if needed, to extend the terminals 148 of the injectors 124. Furthermore, the damper 176 can be eliminated from the injection module assemblies 100, 300, 400, and 500 if desired.

Due to the construction of the injection module assemblies 100, 300, 400, and 500, it is possible and even preferable to assemble the injection module assemblies 100, 300, 400, and 500 at the same facility where the fuel injectors 124 are manufactured. This single-site assembly can be helpful for further reducing the emissions of the entire vehicle in which the injection module assemblies 100, 300, 400, and 500 are installed, because it is easier to assemble each injection module assembly 100, 300, 400, and 500 using a group of injectors 124 having substantially identical fuel flow rates.

In the prior art, fuel injectors are manufactured to operate within a predetermined acceptable flow rate range and are then typically shipped to another site to be assembled on a fuel rail assembly. Commonly the assembled fuel rail assemblies will have injectors with flow rates that vary within the acceptable manufacturing range, thereby creating the possibility for increased emissions. This is because most vehicles use one pre-catalyst oxygen sensor to adjust the flow rates of all of the fuel injectors for a single cylinder bank. Therefore, for example, if three injectors are flowing lean and one injector is flowing rich, the engine control unit would adjust the flow rates of all four injectors to be more rich. The one injector that was previously flowing rich would now flow even more rich, thereby increasing hydrocarbon emissions from the cylinder bank.

Because the injection module assemblies 100, 300, 400, and 500 of the invention can be assembled at the same location the injectors 124 are manufactured and tested, the injectors 124 used for each injection module assembly 100, 300, 400, or 500 can be more carefully matched based on tested flow rates. Where prior art fuel rail assemblies might include injectors with flow rates spread across the entire acceptable manufacturing range, each injection module assembly 100, 300, 400, and 500 can be assembled with injectors 124 having flow rates that tested within a much smaller range than the larger acceptable manufacturing range.

By more carefully matching the flow rates of the injectors 124, the injection module assemblies 100, 300, 400, and 500 will reduce hydrocarbon emissions from each cylinder bank, because each cylinder in the bank will operate closer to the proper air/fuel ratio. Because the flow rates for the group of injectors 124 used in each injection module assembly 100, 300, 400, and 500 can be matched, and because the matched flow rates for one group of injectors 124 can be different from the matched flow rates for another group of injectors 124, the effect of the larger acceptable manufacturing range for the fuel injectors 124 on vehicle emissions can be greatly reduced on each individual injection module assembly 100, 300, 400, and 500.

Various features of the invention are set forth in the following claims.

What is claimed is:

1. An injection module assembly comprising:

a fuel rail defining a passageway through which a fuel can flow;

a fuel injector for delivering the fuel in the passageway to a combustion chamber of an internal combustion engine, the injector being coupled to the fuel rail at an inlet end of the fuel injector such that an interface between the fuel rail and the inlet end is substantially sealed to substantially prevent leakage of both liquid fuel and hydrocarbon emissions from the interface; and an overmolding covering at least a portion of the fuel rail and at least a portion of the fuel injector.

2. The injection module assembly of claim 1, wherein the fuel injector is coupled to the fuel rail by laser welding.

3. The injection module assembly of claim 1, wherein the fuel injector is coupled to the fuel rail by brazing.

4. The injection module assembly of claim 1, wherein the fuel injector is coupled to the fuel rail by TIG welding.

5. The injection module assembly of claim 1, wherein the fuel injector is coupled to the fuel rail without using a seal ring adjacent the interface.

6. The injection module assembly of claim 1, wherein the fuel injector is directly connected to the fuel rail.

7. The injection module assembly of claim 1, wherein the fuel injector is coupled to the fuel rail via an extension tube.

8. The injection module assembly of claim 1, wherein the fuel injector is coupled to the fuel rail via a bellows.

9. The injection module assembly of claim 1, further comprising a damper inside the passageway of the fuel rail for damping pressure pulsations created by the injector.

10. The injection module assembly of claim 1, further comprising an electrical connector coupled to both the fuel rail and the injector for providing electrical power to the injector.

11. The injection module assembly of claim 10, wherein at least a portion of the electrical connector is overmolded.

12. An injection module assembly comprising:

a fuel rail defining a passageway through which a fuel can flow;

a plurality of fuel injectors for delivering the fuel in the passageway to a respective plurality of combustion chambers in an internal combustion engine, the fuel injectors being coupled to the fuel rail such that an interface between the fuel rail and each fuel injector is substantially sealed to substantially prevent leakage of both liquid fuel and hydrocarbon emissions from the interface;

an electrical connector coupled to the fuel rail and to each of the injectors for providing electrical power to each injector; and an overmolding covering at least a portion of the fuel rail, at least a portion of the electrical connector, and at least a portion of each fuel injector.

13. The injection module assembly of claim 12, wherein the fuel injectors are coupled to the fuel rail by laser welding.

14. The injection module assembly of claim 12, wherein the fuel injectors are coupled to the fuel rail by TIG welding.

15. The injection module assembly of claim 12, wherein the fuel injectors are coupled to the fuel rail by brazing.

16. The injection module assembly of claim 12, wherein the fuel injectors are coupled to the fuel rail without using a seal ring adjacent the interface.

17. The injection module assembly of claim 12, further comprising a damper inside the fuel rail for damping pressure pulsations created by the injectors.

18. The injection module assembly of claim 12, wherein the fuel injectors are directly connected to the fuel rail.

19. The injection module assembly of claim 12, wherein the fuel injectors are coupled to the fuel rail via an extension tube.

20. The injection module assembly of claim 12, wherein the fuel injectors are coupled to the fuel rail via a bellows.

21. A method of manufacturing an injection module assembly having a fuel rail, a plurality of fuel injectors, and an electrical connector, the method comprising:

coupling the fuel injectors to the fuel rail such that respective interfaces between the fuel rail and the fuel injectors are substantially sealed to substantially prevent leakage of both liquid fuel and hydrocarbon emissions from the interfaces;

coupling the electrical connector to the fuel rail and to each of the injectors to provide electrical power to the injectors; and overmolding at least a portion of the fuel rail, at least a portion of the electrical connector, and at least a portion of each injector to form an injection module assembly.

22. The method of claim 21, wherein the injectors each define a longitudinal axis and have an outlet end and an inlet end in opposing relation along the respective longitudinal axis, and wherein each injector is coupled to the fuel rail at the inlet end.

23. The method of claim 21, wherein the injectors are coupled to the fuel rail by one of laser welding, TIG welding, and brazing.

24. The method of claim 21, wherein the fuel injectors are coupled to the fuel rail without using a seal ring adjacent the interface.

25. The method of claim 21, further comprising inserting a damper into the fuel rail for damping pressure pulsations created by the injectors.

26. An injection module assembly comprising:

a fuel rail defining a passageway through which a fuel can flow;

a plurality of fuel injectors for delivering the fuel in the passageway to a respective plurality of combustion chambers in an internal combustion engine, the fuel injectors being coupled to the fuel rail at respective interfaces that are substantially sealed to substantially prevent leakage of both liquid fuel and hydrocarbon emissions from the interfaces; and an overmolding covering at least a portion of the fuel rail and at least a portion of each fuel injector.

27. The injection module assembly of claim 26, further comprising an electrical connector coupled to the fuel rail and to each of the injectors for providing electrical power to each injector, and wherein at least portion of the electrical connector is covered by the overmolding.

28. The injection module assembly of claim 26, wherein the fuel injectors are coupled to the fuel rail by one of laser welding, TIG welding, and brazing.

29. The injection module assembly of claim 26, wherein the fuel injectors are coupled to the fuel rail without using a seal ring adjacent each interface.

30. The injection module assembly of claim 26, wherein the fuel rail is metallic.

31. A method of manufacturing an injection module assembly having a fuel rail and a plurality of fuel injectors, the method comprising:

coupling the fuel injectors to the fuel rail at respective interfaces; and overmolding at least a portion of the fuel rail and at least a portion of each injector.

32. The method of claim 31, further comprising:

coupling an electrical connector to the fuel rail and to each of the injectors to provide electrical power to the injectors; and overmolding at least a portion of the electrical connector.

33. The method of claim 31, wherein coupling the fuel injectors to the fuel rail at respective interfaces is intended to substantially seal the respective interfaces to substantially prevent leakage of both liquid fuel and hydrocarbon emissions from the interfaces, and wherein overmolding at least a portion of the fuel rail and at least a portion of each injector provides added sealing in the event the interfaces are not completely sealed by the coupling.

34. The method of claim 31, wherein the fuel injectors are coupled to the fuel rail by one of laser welding, TIG welding, and brazing.

35. The method of claim 31, wherein the fuel injectors are coupled to the fuel rail without using a seal ring adjacent the interface.

36. The injection module assembly of claim 1, wherein the fuel injector defines a longitudinal axis and includes an outlet end and the inlet end in opposing relation along the longitudinal axis.

37. The injection module assembly of claim 1, wherein the fuel rail is metallic.

38. The injection module assembly of claim 12, wherein the fuel rail is metallic.

* * * * *